US008464677B2

(12) United States Patent
Choi et al.

(10) Patent No.: US 8,464,677 B2
(45) Date of Patent: Jun. 18, 2013

(54) VARIABLE VALVE LIFT APPARATUS

(75) Inventors: Byong Young Choi, Incheon (KR); Young Hong Kwak, Suwon (KR); Gee-Wook Shin, Hwaseong (KR); Yoonsik Woo, Yongin-si (KR); Jin Kook Kong, Suwon-si (KR); Soo-Hyung Woo, Yongin-si (KR)

(73) Assignee: Hyundai Motor Company, Seoul (KR)

( * ) Notice: Subject to any disclaimer, the term of this patent is extended or adjusted under 35 U.S.C. 154(b) by 71 days.

(21) Appl. No.: 13/189,713

(22) Filed: Jul. 25, 2011

(65) Prior Publication Data

US 2012/0097878 A1 Apr. 26, 2012

(30) Foreign Application Priority Data

Oct. 22, 2010 (KR) ..... 10-2010-0103359

(51) Int. Cl.
*F01L 1/18* (2006.01)

(52) U.S. Cl.
USPC ..... 123/90.44; 123/90.39

(58) Field of Classification Search
USPC ..... 123/90.39–90.47, 90.16
See application file for complete search history.

(56) References Cited

U.S. PATENT DOCUMENTS

| | | | | |
|---|---|---|---|---|
| 7,377,247 | B2 * | 5/2008 | Seitz | 123/90.39 |
| 8,267,059 | B2 * | 9/2012 | Manther et al. | 123/90.39 |
| 2010/0307438 | A1 * | 12/2010 | Lee et al. | 123/90.55 |
| 2011/0226209 | A1 * | 9/2011 | Zurface et al. | 123/90.44 |

FOREIGN PATENT DOCUMENTS

| | | | |
|---|---|---|---|
| KR | 10-2008-0023036 | A | 3/2008 |
| KR | 10-2009-0043283 | A | 5/2009 |

* cited by examiner

*Primary Examiner* — Thomas Denion
*Assistant Examiner* — Daniel Bernstein
(74) *Attorney, Agent, or Firm* — Morgan, Lewis & Bockius LLP

(57) ABSTRACT

A variable valve lift apparatus includes a high cam and a low cam fixed side by side to a camshaft, an outer body pressed by the rotation of the high cam, and has a crossbar formed at the bottom of the front end, an inner body, of which the front end protrudes further than the outer body, the lower front end is provided with a valve member, the upper rear end is hinged to a lost motion hinge shaft coaxially with the rear end of the outer body, and the lower rear end is pivotally connected to a hinge member, and a latching portion inserted into the inner body and selectively connected to the crossbar of the outer body to move the inner body dependent on movement of the front end of the outer body, wherein the lost motion hinge shaft is disposed in the same direction as a hinge point between the inner body and the hinge member with respect to the camshaft. Dynamic characteristics can be obtained by reducing the moment of inertia of the variable valve lift apparatus, and the dynamic characteristics can be further improved by inserting the latching portion into the inner body so as to be closer to the camshaft.

6 Claims, 13 Drawing Sheets

VARIABLE VALVE LIFT APPARATUS

CROSS-REFERENCE TO RELATED APPLICATION

This application claims priority to and the benefit of Korean Patent Application No. 10-2010-0103359 filed Oct. 22, 2010, the entire contents of which application is incorporated herein for all purposes by this reference.

BACKGROUND OF INVENTION

1. Field of Invention

The present invention relates to a variable valve lift apparatus, and more particularly, to a variable valve lift apparatus in which a latching portion connecting an inner body and an outer body is disposed adjacent to a cam, and a lost motion hinge shaft and a hinge point of the variable valve lift apparatus are disposed in the same direction relative to a camshaft.

2. Description of Related Art

In general, an internal combustion engine generates power by taking in fuel and air and burning it in a combustion chamber. Intake valves are operated by a camshaft in order to intake the air, and the air is drawn into the combustion chamber while the intake valves are open. In addition, exhaust valves are operated by the camshaft, and exhaust gas is expelled from the combustion chamber while the exhaust valves are open.

An optimal operation of the intake and exhaust valves depends on the rotation speed of the engine. That is, an optimal lift or optimal opening/closing timing of the valves depends on the rotation speed of the engine. In order to achieve such an optimal valve operation depending on the rotation speed of the engine, research has been undertaken for a variable valve lift (VVL) apparatus that includes a plurality of cams for driving the valves, or varies the lift of the valves depending on the number of rotations of the engine.

In a conventional variable valve lift apparatus, as shown in FIG. 10, a lost motion hinge shaft 40 connecting an outer body 10 and one side of an inner body 20 and a hinge shaft 60 of the variable valve lift apparatus are formed at the left and right of a camshaft.

FIG. 11*a* is a longitudinal cross-sectional view of the conventional variable valve lift apparatus in a latching operation, and FIG. 11*b* is a longitudinal cross-sectional view of the conventional variable lift apparatus in an unlatching operation. Conventionally, as shown in FIGS. 11*a* and 11*b*, the outer body 10 and the other side of the inner body 20 are connected by a latching mechanism 30 inserted into the outer body 10. Moreover, in an unlatching operation, the inner body 20 creates lost motion by a lost motion spring 50.

As the latching mechanism 30 is inserted into the outer body 10 as described above, the latching mechanism 30 becomes distant from the camshaft to thereby deteriorate the dynamic characteristics of the variable valve lift apparatus due to the moment of inertia. Also, a valve member is positioned under the lost motion spring 50, and such an apparatus has to press the valve member, thereby making the actual manufacture of the apparatus difficult.

The information disclosed in this Background section is only for enhancement of understanding of the general background of the invention and should not be taken as an acknowledgement or any form of suggestion that this information forms the prior art already known to a person skilled in the art.

SUMMARY OF INVENTION

Various aspects of the present invention provide for a variable valve lift apparatus having the advantage of obtaining dynamic characteristics by reducing the moment of inertia of the variable valve lift apparatus, in which a latching portion is inserted into an inner body and positioned midway between a valve member and a hinge member, and a lost motion hinge point and the hinge member are positioned in the same direction relative to a camshaft.

Various aspects of the present invention provide for a variable valve lift apparatus including a high cam and a low cam fixed side by side so as to be eccentric to a camshaft, an outer body which is pressed by the rotation of the high cam, and has a crossbar formed at the bottom of the front end, an inner body, of which the front end protrudes further than the outer body, the lower front end is provided with a valve member, the upper rear end is hinged to a lost motion hinge shaft coaxially with the rear end of the outer body, and the lower rear end is pivotally connected to a hinge member, and a latching portion which is inserted into the inner body and selectively connected to the crossbar of the outer body to make the movement of the inner body to be dependent on the movement of the front end of the outer body, wherein the lost motion hinge shaft is disposed in the same direction as a hinge point between the inner body and the hinge member with respect to the camshaft.

Moreover, the latching portion according to various aspects of the present invention may include a hollow cylindrical latching pin, and a return spring which is inserted into the latching pin and selectively moves the latching pin by being selectively compressed or released by supply of oil.

Furthermore, the latching portion according to various aspects of the present invention may further include a return spring support pin which is positioned at the end of the return spring, and inserted and fixed into the inner body to restrict the movement of the latching pin.

In addition, the latching portion according to the various aspects of the present invention is positioned midway between the hinge member connected to the lower rear end of the inner body and the valve member.

Various aspects of the present invention provide for a variable valve lift apparatus including a high cam and a low cam fixed side by side to a camshaft, an outer body which is pressed by the rotation of the low cam, and of which the front end is provided with a valve member, the upper rear end is hinged to a lost motion hinge shaft, and the lower rear end is pivotally connected to a hinge member, an inner body which is inserted into the outer body, and of which the rear end is hinged to the lost motion hinge shaft coaxially with the outer body, and a latching portion which is inserted into the inner body and selectively moved into the outer body to selectively connect the outer body and the inner body, wherein the lost motion hinge shaft is disposed in the same direction as a hinge point between the outer body and the hinge member with respect to the camshaft.

Moreover, the latching portion according to various aspects of the present invention may include a hollow cylindrical latching pin formed perpendicular to the lost motion hinge shaft, and a return spring which is inserted into the latching pin and selectively moves the latching pin by being selectively compressed or released by supply of oil.

Furthermore, the latching portion according to various aspects of the present invention may further include a return spring support pin which is positioned at the end of the return spring, and inserted and fixed into the inner body to restrict the movement of the latching pin.

In addition, the latching portion according to various aspects of the present invention is positioned midway between the hinge member connected to the lower rear end of the inner body and the valve member.

According to the above-described variable valve lift apparatus, dynamic characteristics can be obtained by reducing the moment of inertia of the variable valve lift apparatus, and the dynamic characteristics can be further improved by inserting the latching portion into the inner body so as to be closer to the camshaft.

The methods and apparatuses of the present invention have other features and advantages which will be apparent from or are set forth in more detail in the accompanying drawings, which are incorporated herein, and the following Detailed Description, which together serve to explain certain principles of the present invention.

DETAILED DESCRIPTION

Figure 1:
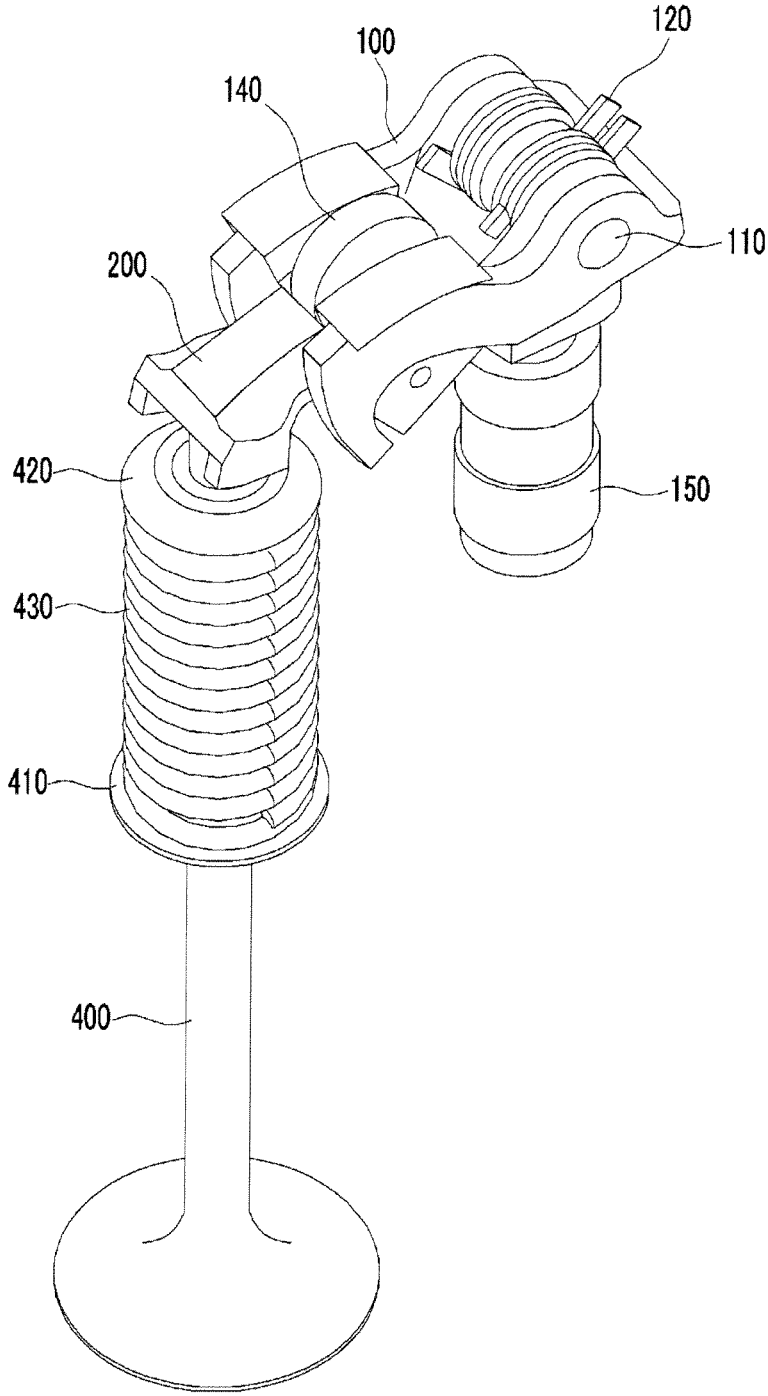
FIG. 1 is a perspective view of an exemplary variable valve lift apparatus according to the present invention.

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

In the variable valve lift apparatus of the present invention, rotating high and low cams having different cam profiles and arranged side by side on an outer side of a cylinder are respectively in rolling contact with the outer body or the inner body, and the outer body and the inner body are connected coaxially with the lost motion hinge shaft.

With reference to FIGS. 1 to 4, in the variable valve lift apparatus according to various embodiments of the present invention, an outer body 100 is pressed by a high cam 170, and an inner body 200 is pressed by a low cam 160. The outer body 100 and the inner body 200 are rotatable coaxially with the lost motion hinge shaft 110. Since a valve member 400 is disposed at the front end of the inner body 200, the valve member 400 is pressed by rotation of the inner body 200. The lower rear end of the inner body 200 is hinged to a hinge member 150. A valve stem end 420 is formed at the upper end of the valve member 400, and a valve spring seat 410 is formed at an intermediate portion thereof. As the valve spring 430 is positioned between the valve stem end 420 and the valve spring seat 410, the valve member 400 ascends and descends by the valve spring 430. Moreover, the outer body 100 has a U-shaped crossbar 180 which is formed below the inner body 200 to support the inner body 200. In a latching operation, as a latching portion 300 inserted into the inner body 200 protrudes outwardly, the outer body 100 is fit between the inner body 200 and the latching portion 300, thus causing the movement of the inner body 200 to be dependent on the movement of the outer body 100. Therefore, the inner body 200 can ascend and descend as the outer body 100 ascends and descends.

Figure 4:
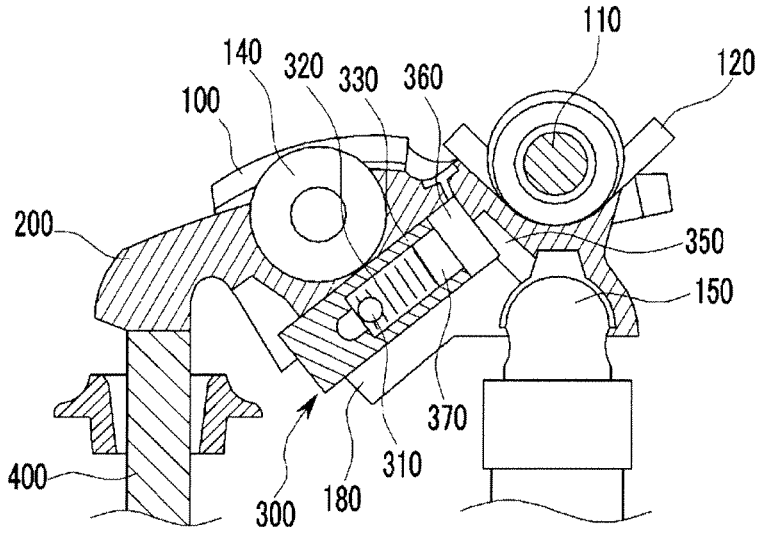
FIG. 4 is a longitudinal cross-sectional view of FIG. 3.

The latching portion 300 is inserted into the inner body 200. Upon selective supply of oil, the latching portion 300 moves and latches the outer body 100 and the inner body 200. In the latching operation, the front lower end of the outer body 100 presses the latching portion 300 and thereby simultaneously presses the inner body 200 into which the latching portion 300 is inserted. This is illustrated in FIG. 4.

The latching portion 300 is positioned midway between the valve member 400 and the hinge member 150, and in various embodiments, directly below a camshaft. To this end, the latching portion 300 has to be inserted into the inner body 200. This is to reduce the moment of inertia by shortening the distance from the lost motion hinge shaft 110 to the camshaft.

On the other hand, in an unlatching operation, the latching is released as the latching portion 300 returns to the original state. The outer body 100 create lost motion in the unlatching operation, which is performed by a lost motion spring 120 connected to the lost motion hinge shaft 110.

The latching portion 300 includes a hollow cylindrical latching pin 330, a return spring 320 inserted into the latching pin 300 and selectively compressed or released by supply of oil, a return spring support pin 310 restricting the movement of the latching pin 330 along with the return spring 310, and a stopper 370 stopping the supply of oil and making contact with the return spring 320.

Figure 5:
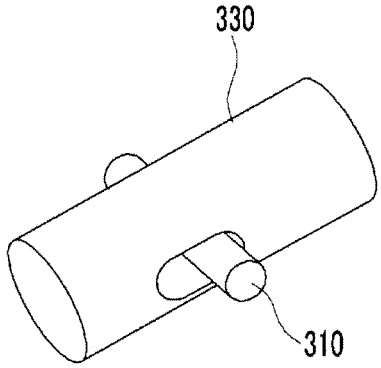
FIG. 5 is a perspective view of an exemplary latching portion according to the present invention.

FIG. 5 is a perspective view of the latching portion 300. While the return spring support pin 310 is inserted and fixed into the inner body 200, the latching pin 330 moves left and right relative to the return spring support pin 310.

Figure 7:
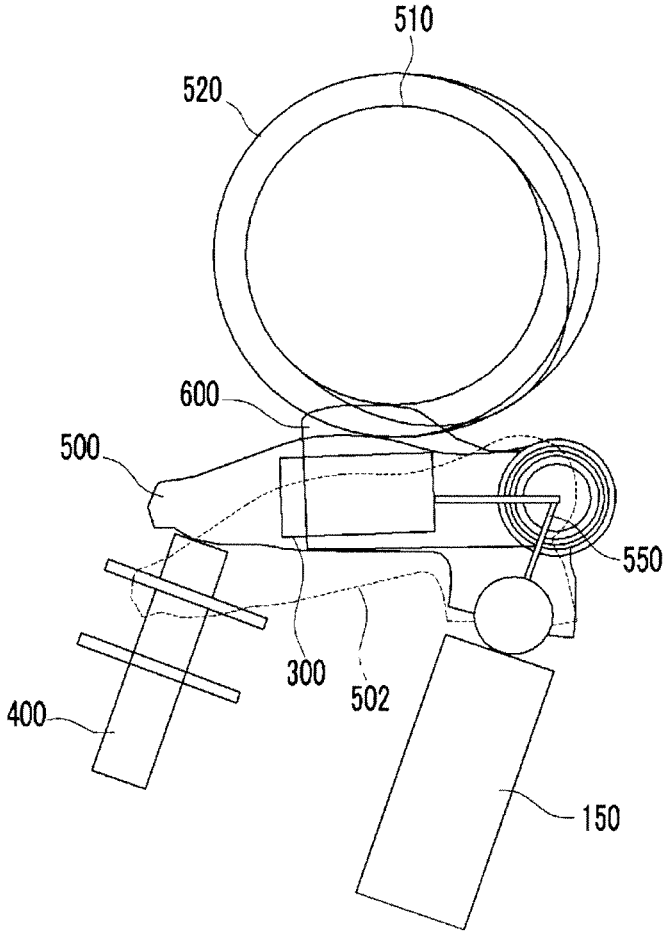
FIG. 7 is a side cross-sectional view of another exemplary variable valve lift apparatus according to the present invention.
Figure 8:
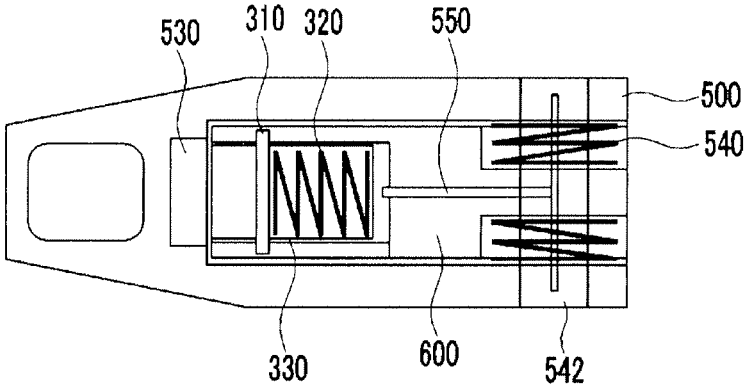
FIG. 8 is a top plan view of the variable valve lift apparatus of FIG. 7.
Figure 9:
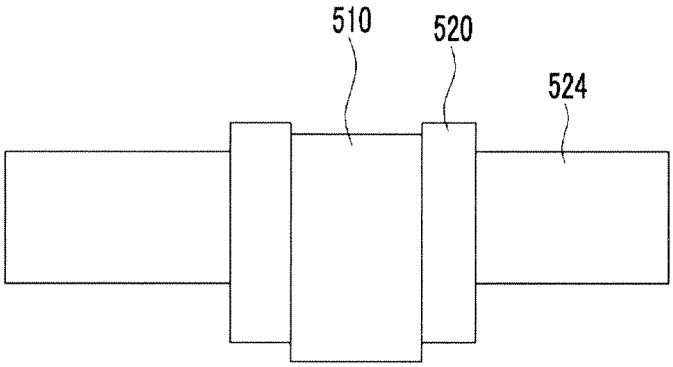
FIG. 9 is a cross-sectional view of the cam and camshaft of FIG. 7.
Figure 10:
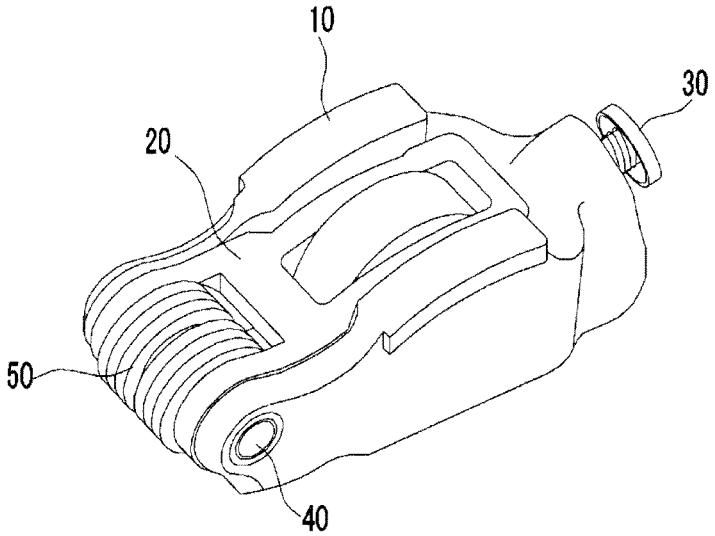
FIG. 10 is a perspective view of a conventional variable valve lift apparatus.
Figure 11A:
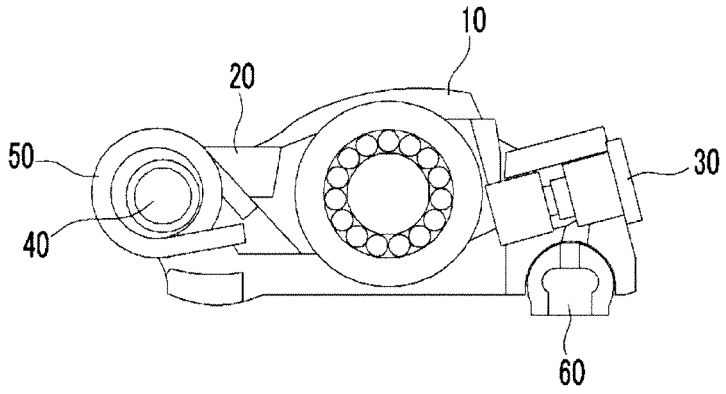
FIG. 11*a* is a longitudinal cross-sectional view of the conventional variable valve lift apparatus in the latching operation.
Figure 11B:
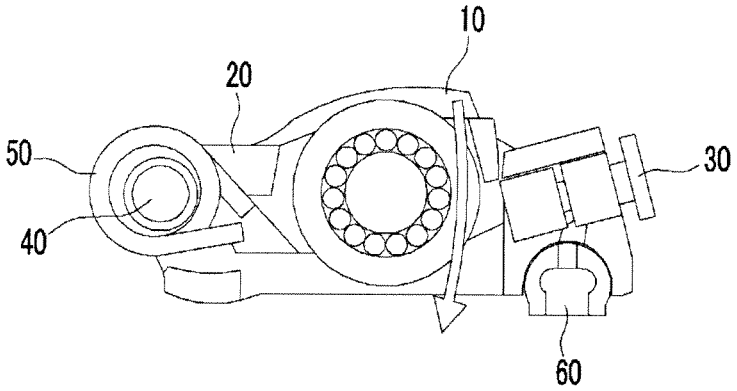
FIG. 11*b* is a longitudinal cross-sectional view of the conventional variable valve lift apparatus in the unlatching operation.

Turning now to FIGS. 7 to 9, FIG. 7 is a cross-sectional view of a variable valve lift apparatus according to various embodiments of the present invention, in which, unlike some embodiments described above, the front end of the outer body 500 is in contact with the valve member 400, and the rear end of the outer body 500 is hinged to the hinge member 150. Moreover, unlike some embodiments described above, the low cam 520 is in contact with the inner body 600, and the high cam 510 is in contact with the outer body 500. FIG. 9 shows a connection relationship among the camshaft 524, low cam 520, and high cam 510 of the variable valve lift apparatus according to various embodiments of the present invention.

Except as mentioned above, the various embodiments are similar to those described above. For example, in the apparatus shown in FIG. 7, too, the latching portion 300 is inserted into the inner body 600, and the latching portion 300 includes a latching pin 330, a return spring 320, a return spring support pin 310, and a stopper 370.

As in the above-described embodiments, the latching portion 300 is positioned midway between the valve member 400 and the hinge member 150, and in various embodiments, positioned directly below the camshaft. To this end, the latching portion 300 has to be inserted into the inner body 600. This is to reduce the moment of inertia by shortening the distance from the lost motion hinge shaft 550 to the camshaft.

Now, an operating process of the latching portion 300, a part common to illustrated exemplary embodiments of the present invention, will be described in more detail.

Figure 6A:
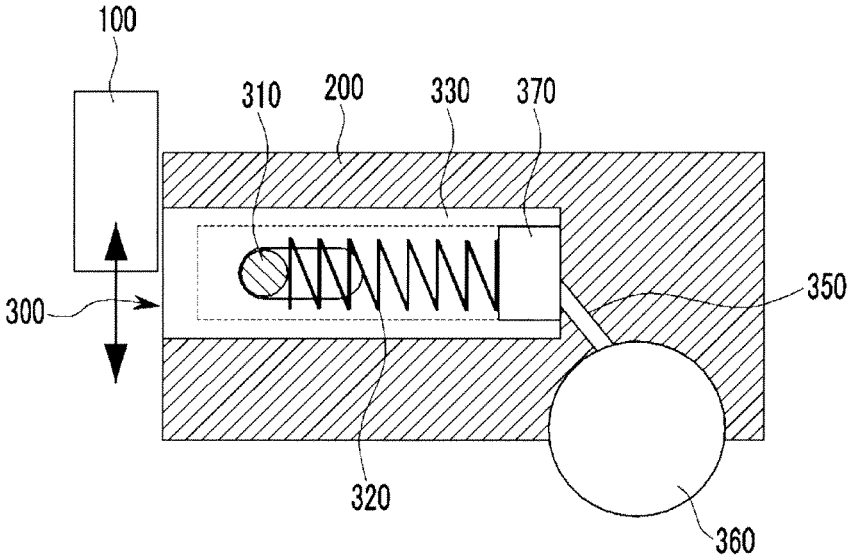
FIG. 6*a* is a cross-sectional view of the latching portion of FIG. 5 and an outer body in an unlatching operation according to the present invention.
Figure 6B:
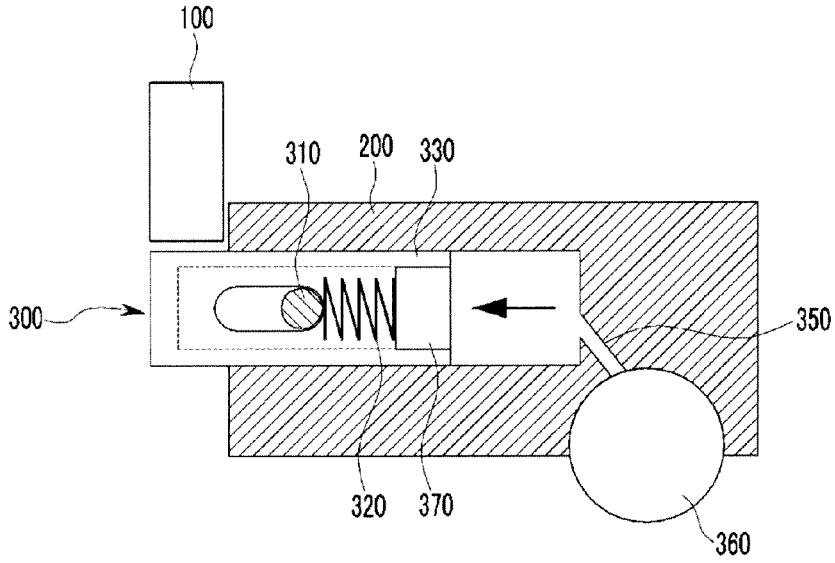
FIG. 6*b* is a cross-sectional view of the latching portion of FIG. 5 and the outer body in a latching operation according to the present invention.

FIG. 6*b* illustrates a connection relationship between the latching portion 300 and the outer body 100 in the latching operation according to various embodiments. When the oil in the oil chamber 360 is introduced into the latching pin 330 via an oil supply passage 350, a hydraulic pressure is generated to push the latching pin 330. At this time, the latching pin 330 compresses the return spring 320 against the return spring support pin 310.

That is, the return spring support pin 310 is not moved, while the latching pin 330 is moved in the direction of the arrow in FIG. 6*b*. As such, the latching pin 330 is moved to a latching portion connecting groove 530 (see FIG. 8), and the outer body 100 presses the latching pin 330 when a driving cam is operated. Thus, the inner body 200 with the latching pin 330 inserted therein also descends. By doing so, a latching mode, i.e., high lift, is performed.

On the other hand, in the unlatching operation, the oil in the latching pin 330 is discharged, as shown in FIG. 6*a*. Thus, the compressed return spring 320 is released. Following the release of the return spring 320, the latching pin 330 returns to the original state. As a result, the latching pin 330 is inserted into the inner body 200, and thus the inner body 200 is not affected at all even if the outer body 100 descends. That is, the outer body 100 creates lost motion. By doing so, low lift is achieved.

In the exemplary embodiment illustrated in FIG. 7, too, in the latching and unlatching modes, the inner body 600 is selectively latched to the outer body 500 by the movement of the latching portion 300 inserted into the inner body 600.

An operating process of various embodiments will now be described with reference to the accompanying drawings.

Figure 2:
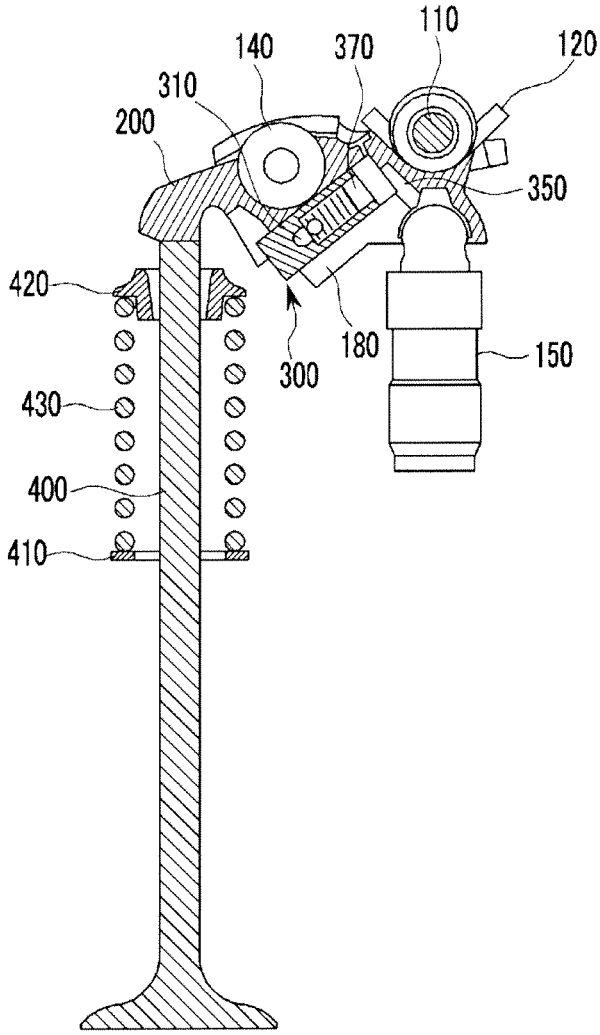
FIG. 2 is a longitudinal cross-sectional view of FIG. 1.
Figure 3:
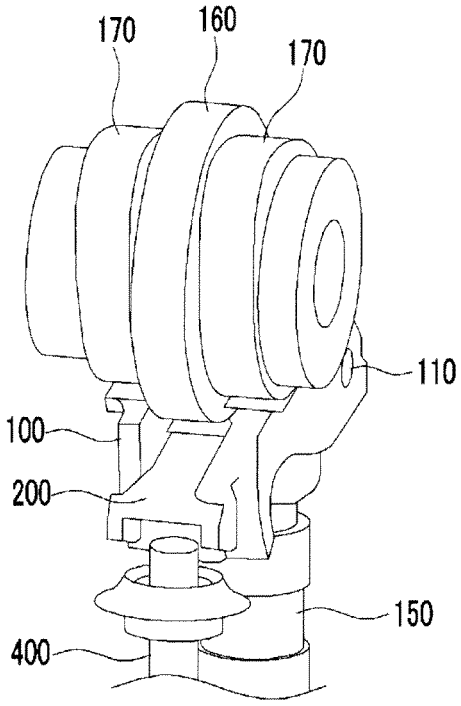
FIG. 3 is an enlarged view of exemplary parts of the variable valve lift apparatus of FIG. 1.

As shown in FIG. 1 and FIG. 2, the outer body 100 and the inner body 200 are hinged by the lost motion hinge shaft 110. Thus, the outer body 100 and the front end of the inner body 200 rotate centering around the lost motion hinge shaft 110. At this time, the inner body 200 controls the intake and exhaust device of a valve by pressing the valve member 400. Moreover, the high cam 170 presses the outer body 100, and the low cam 160 presses the inner body 200.

As shown in FIG. 6*b*, in the latching of the outer body 100 and the inner body 200, the latching pin 330 is exposed to the outside as the latching pin 330 compresses the return spring 320 by the hydraulic pressure generated when oil is supplied via the oil supply passage 350. At this time, the return spring support pin 310 is fixed. In this state, if the outer body 100 descends, the outer body 100 presses the latching pin 330. As a result, the inner body 100 with the latching pin 330 inserted therein descends too. In this way, high lift, which is the latching mode, is achieved. In this case, the low cam 160 and the inner body 200 are not in contact with each other.

On the other hand, the unlatching of the outer body 100 and the inner body 200 begins when the oil in the latching pin 330 is discharged. As the oil is discharged, the hydraulic pressure for compressing the return spring 320 is released, and therefore the return spring 320 is released. That is, the latching pin 330 returns to the original state, being supported on the return spring support pin 310, by the restoring force of the return spring 320. As a result, the latching pin 330 is inserted again into the inner body 200, thereby unlatching the outer body 100 and the inner body 200. In this way, low lift, which is the unlatching mode, is achieved. At this time, the outer body 100 creates lost motion, which is performed by the lost motion spring 120.

With reference to FIGS. 7-10, an operating process of the illustrated exemplary embodiment of the present invention will be described below. It should be noted that the latching portion 300 of the illustrated exemplary embodiment is identical to those described above.

The difference between the illustrated exemplary embodiment and those described above is that the outer body 500 is adapted to press the valve member 400. That is, in the above-described embodiments, the outer body 199, which does not directly press the valve member 400, creates lost motion since the inner body 200 presses the valve member 400, whereas in the exemplary embodiment illustrated in FIG. 7, the inner body 600, which is not in direct contact with the valve member 400, creates lost motion. The lost motion created at this time is performed by the lost motion spring 540.

Moreover, the low cam 520 presses the outer body 500, and the high cam 510 presses the inner body 600.

The operating process of the latching operation of the exemplary embodiment illustrated in FIG. 7 will be discussed in more detail. As the latching pin 300 compresses the return spring 320 by the hydraulic pressure generated when oil is supplied to the latching pin 300 via the oil supply passage 550, the latching pin 300 is inserted into the latching portion connecting groove 530 (see FIG. 8). Thus, the outer body 500 and the inner body 600 are connected together. With the outer body 500 and the inner body 600 being connected together, the high cam 510 presses the inner body 600 while rotating. As a result, as shown in FIG. 7, when the outer body 500 rotates, it has the profile of an outer body 502 drawn in dotted line. In this way, the outer body 500 connected to the inner body 600 presses the valve member 400, thereby achieving high lift.

In the unlatching operation of various embodiments, the return spring 320 is released as the oil is discharged via the oil supply passage 550. By the releasing operation of the return spring 320, the latching pin 330 returns to the original state. Thus, the outer body 500 and the inner body 600 are disconnected from each other. Therefore, the outer body 500 and the inner body 600 are independently operated, and the inner body 600 exerts no effect at all on the outer body 500 when the high cam 510 presses the inner body 600. Thus, the inner body 600 creates lost motion. In this way, low lift is achieved.

As seen from above, when the outer body 100 and 500 and the inner body 200 and 600 are selectively connected together by the latching portion 300, the lost motion hinge shaft 110 and a hinge point between the inner body 100 or outer body 500 and the hinge member 150 are disposed in the same direction relative to the camshaft. This reduces the moment of inertia, thus improving the dynamic characteristics.

In the present invention, the hinge point between the inner body 100 or outer body 500 and the hinge member 150 is referred to as the hinge point of the variable valve lift apparatus.

For convenience in explanation and accurate definition in the appended claims, the terms upper or lower, front or rear, and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A variable valve lift apparatus comprising:

a high cam and a low cam fixed side by side so as to be eccentric to a camshaft;

an outer body pressed by the rotation of the high cam, and has a crossbar formed at the bottom of a front end;

an inner body, of which a lower front end protrudes further than the outer body, the lower front end includes a valve member, an upper rear end is pivotally connected to a lost motion hinge shaft coaxially with a rear end of the outer body, and the lower rear end is pivotally connected to a hinge member; and a latching portion inserted into the inner body and selectively connected to the crossbar of the outer body to make movement of the inner body dependent on the movement of the front end of the outer body;

wherein the lost motion hinge shaft is disposed in the same direction as a hinge point between the inner body and the hinge member with respect to the camshaft; and wherein the latching portion is positioned midway between the hinge member connected to the lower rear end of the inner body and the valve member.

2. The apparatus of claim 1, wherein the latching portion comprises:

a hollow cylindrical latching pin; and a return spring inserted into the latching pin and selectively moves the latching pin by being selectively compressed or released by supply of oil.

3. The apparatus of claim 2, wherein the latching portion comprises a return spring support pin positioned at the end of the return spring, and inserted and fixed into the inner body to restrict the movement of the latching pin.

4. A variable valve lift apparatus comprising:

a high cam and a low cam fixed side by side to a camshaft;

an outer body pressed by the rotation of the low cam, and of which a front end includes a valve member, the upper rear end is pivotally connected to a lost motion hinge shaft, and a lower rear end is pivotally connected to a hinge member;

an inner body inserted into the outer body, and of which a rear end is pivotally connected to the lost motion hinge shaft coaxially with the outer body; and a latching portion inserted into the inner body and selectively moved into the outer body to selectively connect the outer body and the inner body;

wherein the lost motion hinge shaft is disposed in the same direction as a hinge point between the outer body and the hinge member with respect to the camshaft; and wherein the latching portion is positioned midway between the hinge member connected to the lower rear end of the inner body and the valve member.

5. The apparatus of claim 4, wherein the latching portion comprises:

a hollow cylindrical latching pin formed perpendicular to the lost motion hinge shaft; and a return spring inserted into the latching pin and selectively moves the latching pin by being selectively compressed or released by supply of oil.

6. The apparatus of claim 5, wherein the latching portion further comprises a return spring support pin positioned at the end of the return spring, and inserted and fixed into the inner body to restrict the movement of the latching pin.

* * * * *